US006669328B2

(12) United States Patent
Lin

(10) Patent No.: US 6,669,328 B2
(45) Date of Patent: Dec. 30, 2003

(54) WIPER FOR AVOIDING INK RESIDUES ADHERING ON SIDE SURFACES OF A PRINT HEAD

(75) Inventor: Tsung-Te Lin, Sanchung (TW)

(73) Assignee: Benq Corporation (TW)

( * ) Notice: Subject to any disclaimer, the term of this patent is extended or adjusted under 35 U.S.C. 154(b) by 0 days.

(21) Appl. No.: 10/135,399

(22) Filed: May 1, 2002

(65) Prior Publication Data

US 2002/0163555 A1 Nov. 7, 2002

(30) Foreign Application Priority Data

May 7, 2001 (TW) ..... 90207391 U

(51) Int. Cl.[7] ..... B41J 2/165
(52) U.S. Cl. ..... 347/33
(58) Field of Search ..... 347/33, 22, 32

(56) References Cited

U.S. PATENT DOCUMENTS 6,340,218 B1 * 1/2002 Gaylor ..... 347/33

FOREIGN PATENT DOCUMENTS

JP 6-134998 * 5/1994 ..... 347/33

* cited by examiner

*Primary Examiner*—Thinh Nguyen
(74) *Attorney, Agent, or Firm*—Rabin & Berdo, PC

(57) ABSTRACT

A wiper for avoiding ink residues adhering on side surfaces of a print head comprises a main body. The main body comprises a supporting portion, flexible portion, and wiping portion, which are sequentially connected with each other from bottom to top. The wiping portion has a wiping end and a contacting end. The wiping end extends from one side of the wiping portion while the contacting end is positioned on the top of the wiping portion. Before the print head contacts the contacting end, the contacting end is higher than the nozzle surface and the wiping end is lower than the nozzle surface. After the print head contacts the contacting end, the flexible portion bends down so that the contacting end is lower than the nozzle surface and the wiping end contacts the nozzle surface for wiping the ink residue on the nozzle surface.

12 Claims, 14 Drawing Sheets

WIPER FOR AVOIDING INK RESIDUES ADHERING ON SIDE SURFACES OF A PRINT HEAD

This application incorporates by reference of Taiwan application Ser. No. 090207391, filed May 7, 2001.

BACKGROUND OF THE INVENTION

1. Field of the Invention

The invention relates in general to a wiper for cleaning the nozzle surface, and more particularly to a wiper for avoiding ink residues on side surfaces of the print head.

2. Description of the Related Art

In the technology booming age, the ink-jet machine, such as the ink-jet printer or inkjet copier, has grown in popularity and thus becomes indispensable for people's life. For example, the ink-jet printer is capable of printing the document by linking the ink-jet printer and the computer so as to improve work efficiency.

The ink required by the ink-jet machine is contained in the cartridge while the print head is positioned at the bottom of the cartridge. The print head jets small ink droplets onto the paper through the nozzle surface of the print head to create an output image. Accordingly, the ink residues adhere to the nozzle surface. If the ink residues are accumulated without cleaning, the dried ink residues are possible to form blockages in the print head or smudge the paper, which might decrease the printing quality. Therefore, the printing work shall be halted for wiping the ink residues on the nozzle surface in the cleaning area inside the ink-jet machine whenever the printing has performed several times. The following description takes an ink-jet printer as an example of the ink-jet machine.

Referring to FIG. 1A, it shows the top view of a conventional ink-jet printer. The ink-jet printer 100 comprises a casing 101, print head 102, and cleaning area 106. The print head 102 inside the casing 101 is driven by a driving device (not shown in FIGS) and moves back and forth on the paper to be printed 104 along the direction of the arrow sign 150 of FIG. 1A. The print head 102 jets ink droplets onto the paper to be printed 104 and the paper to be printed 104 moves upward along the direction of the arrow sign 160 of FIG. 1A to complete the printing work. The cleaning area 106 includes a wiper, cap, and blotter. The wiper is for wiping the ink residues on the surface of the print head 102. The cap is the cover of the print head 102 for preventing the ink from being dried to form blockages in the print head 102 while the print head is homed at the cleaning area 106. The blotter is for blotting out the ink splashed during the cleaning.

The structure of the wiper 130 in the cleaning area 106 is disclosed in U.S. Pat. No. 5,612,722 by Monty L. Francis, Edmund H. James, III, and Donald N. Spitz. Lateral views of the print head and the wiper of FIG. 1A are shown in FIG. 1B. The wiper 130 includes a main body 108 and a base 118. The main body 108 has a supporting portion 109, flexible portion 112, and wiping portion 114. The supporting portion 109 has a groove 116 for the insertion of the protruding end 115 of the supporting portion 109 so that the main body 108 can be mounted on the base 118. The flexible portion 112 is disposed upon the supporting portion 109, the wiping portion 114 is upon the flexible portion, and therefore the supporting portion 109, flexible portion 112, and wiping portion 114 are in one unity.

Please refer to FIG. 1C, the enlarged view of the wiping portion 114 of FIG. 1B is shown. The wiping portion 114 has a coplanar surface 120, wiping ends 122*a* and 122*b*. The wiping ends 122*a* and 122*b* are disposed at two sides of the coplanar surface 120 and form two acute angles respectively. The coplanar surface 120 is level with the wiping ends 122*a* and 122*b*. Besides, the plane formed by the coplanar surface 120 and the wiping ends 122*a* and 122*b* is higher than the plane level L of the nozzle surface 110. When the wiper 130 is stationary and the print head 102 moves back and forth along the direction of the arrow sign 170 of FIG. 1B, the wiping ends 122*a* and 122*b* contact the side surfaces 102*a* and 102*b* of the print head 102 respectively. The flexible portion 112 bends down while the print head 102 pushes the wiping portion 114. The wiping ends 122*a* and 122*b* touches the nozzle surface 110 and then the ink residues on the nozzle surface 110 is removed as the relative motion between the print head 102 and the wiper 130 proceeds.

Referring to FIGS. 2A to 2G, it schematically illustrates the wiping sequences of the wiper of FIG. 1B for wiping the ink residues. Referring first to FIG. 2A, as the print head 102 approaches the wiping end 122*a* along the direction of the arrow sign 180 of FIG. 2A, the side surface 102*a* of the print head 102 subsequently touches and pushes the wiping end 122*a* so that the flexible portion 112 bends to the right. As shown in FIG. 2B, the print head 102 proceeds to move along the direction of the arrow sign 180 of FIG. 2B. Subsequently, the wiping end 122*a* touches the nozzle surfaces 110 and removes the ink residue 111 as the relative motion between the print head 102 and the wiping end 122*a* proceeds. Referring to FIG. 2C, the wiping end 122*a* comes off the nozzle surface 110 and the ink residue 111 adheres to the left side of the wiping end 122*a*. Meanwhile, the flexible portion 112 recovers to the former shape and the plane formed by the coplanar surface 120 and the wiping ends 122*a* and 122*b* is higher than the plane level L of the nozzle surface L again.

On the other hand, when the print head 102 approaches the wiping end 122*b* along the direction of the arrow sign 190 of FIG. 2C, the side surface 102*b* of the print head 102 subsequently touches and pushes the wiping end 122*b* so that the flexible portion 112 bends to the left as shown in FIG. 2D. The print head 102 proceeds to move along the direction of the arrow sign 190 of FIG. 2D and the wiping end 122*b* subsequently touches the nozzle surfaces 110 and performs wiping. Once the wiping end 122*b* comes off the nozzle surface 110, the flexible portion 112 recovers to the former shape and the ink residue 111 remains adhering to the left side of the wiping end 122*a* as shown in FIG. 2E. At this time, if the print head 102 approaches the wiping end 122*a* along the direction of the arrow sign 180 of FIG. 2E again, the side surface 102*a* of the print head 102 subsequently touches the wiping end 122*a* and the ink residue 111 as shown in FIG. 2F As shown in FIG. 2G, the ink residue 111 is shifted from the left side of the wiping end 122*a* to the side surface 102*a* of the print head 102.

Conventionally, the wiping ends 122*a* and 122*b* of the main body 108 are two sides of the coplanar surface 120. The coplanar surface 120 is level with the wiping ends 122*a* and 122*b* and the wiping force is generated by the deformation of the main body 108 due to the relative motion between the print head 102 and the wiping ends 122*a* and 122*b*. The ink residue 111 on the nozzle surface 110 is removed by the wiping end 122*a* and 122*b* and finally adheres to the side surface 102*a* and 102*b* of the print head 102. Consequently, when the cleaning completes and the print head 102 proceeds to print, the ink residue 111 adheres to the side surface 102*a* and 102*b* of the print head 102 might fall to the paper to be printed 104. The paper is smudged with the ink residues and the printing quality is therefore decreased.

SUMMARY OF THE INVENTION

It is therefore an object of the invention to provide a wiper for avoiding ink residues on side surfaces of the print head. It keeps side surfaces of the print head clean and ensures the printing quality.

The invention achieves the above-identified objects by providing a wiper for avoiding ink residues on side surfaces of a print head, the wiper comprises a main body and a base. The main body comprises a supporting portion, flexible piece, and wiping portion. The flexible piece is disposed upon the supporting portion and the wiping portion is disposed upon the flexible piece. The wiping portion has a wiping end and a contacting end. The wiping end extends from one side of the wiping portion while the contacting end is positioned on the top of the wiping portion. Before the print head contacts the contacting end, the contacting end is higher than the nozzle surface and the wiping end is lower than the nozzle surface. After the print head contacts the contacting end, the flexible piece bends down due to the relative motion between the print head and the wiper so that the contacting end is lower than the nozzle surface and the wiping end contacts the nozzle surface for wiping the ink residue on the nozzle surface.

Other objects, features, and advantages of the invention will become apparent from the following detailed description of the preferred but non-limiting embodiments. The following description is made with reference to the accompanying drawings.

DETAILED DESCRIPTION OF THE INVENTION

The wiper according to the invention comprises a main body and a base. Different from the conventional wiper, the wiper in this invention has a contacting end on the top of the wiping end. Both the contacting end and the wiping end are disposed in the main body of the wiper. The wiping end does not touch two side surfaces of the print head during the cleaning. Besides, the contacting end does not touch the nozzle surface while wiping the ink residues on the nozzle surface. Therefore, the main body is used for wiping the ink residues on the nozzle surface. It prevents the ink residues on the wiping end of the wiper from being shifted to side surfaces of the print head. It also prevents the ink residues adhering to the side surfaces of the print head from falling onto the paper. It keeps side surfaces of the print head clean and ensures the printing quality.

Figure 1A:
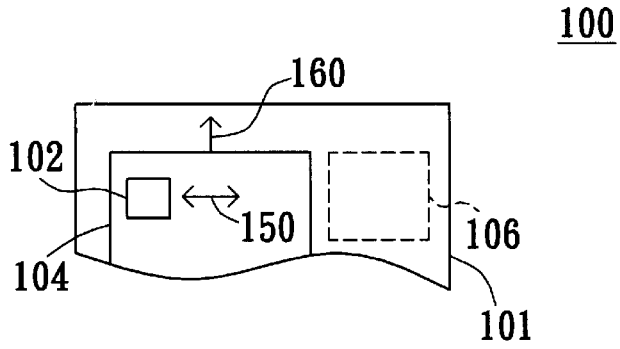
FIG. 1A (PRIOR ART)
FIG. 1A (Prior Art) is the top view of a conventional ink-jet printer.
Figure 1B:
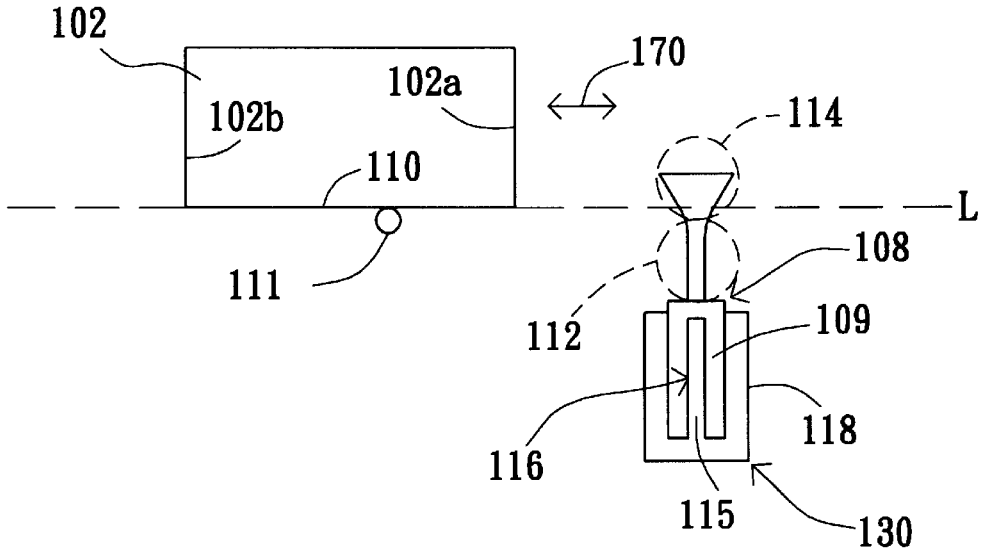
FIG. 1B (PRIOR ART)
FIG. 1B shows lateral views of the print head and the wiper of FIG. 1A.
Figure 1C:
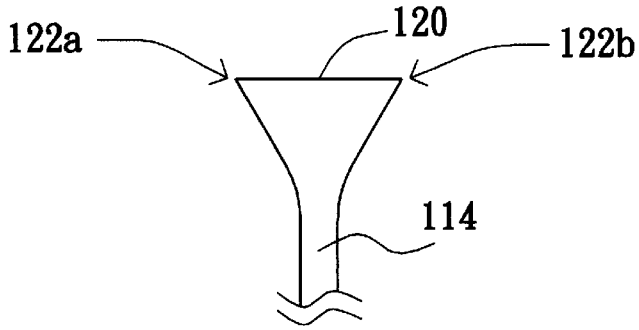
FIG. 1C (PRIOR ART)
FIG. 1C shows the lateral view of the wiping portion of FIG. 1B.
Figure 2A:
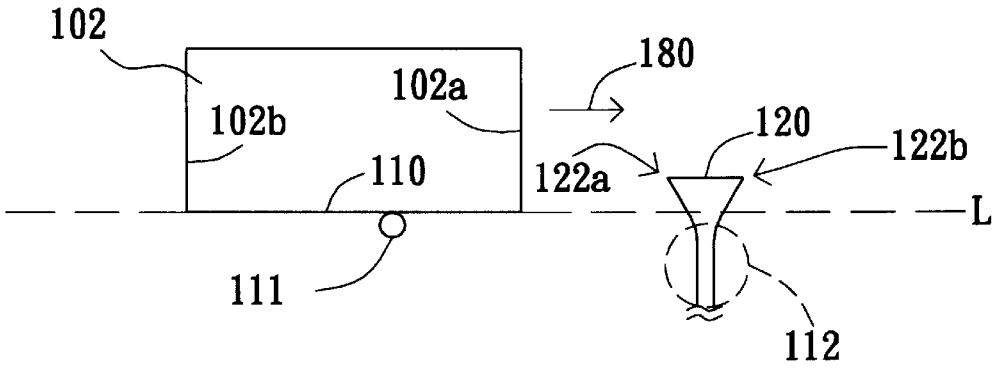
FIG. 2A (PRIOR ART)
FIGS. 2A~2G schematically illustrates the wiping sequences of the wiper of FIG. 1B for wiping the ink residues.
Figure 2B:
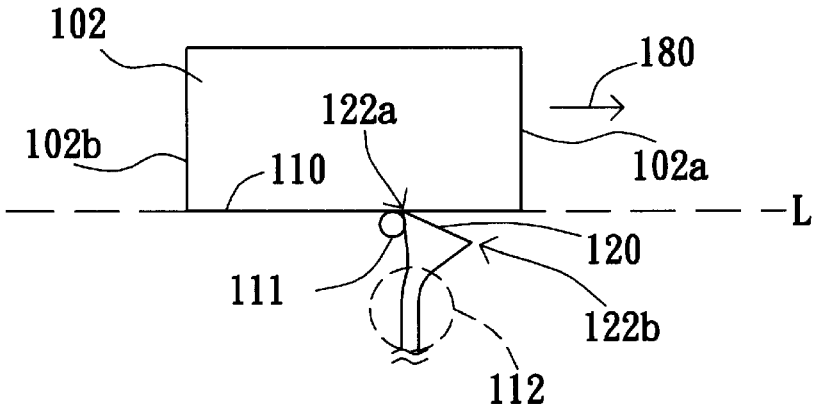
FIG. 2B (PRIOR ART)
Figure 2C:
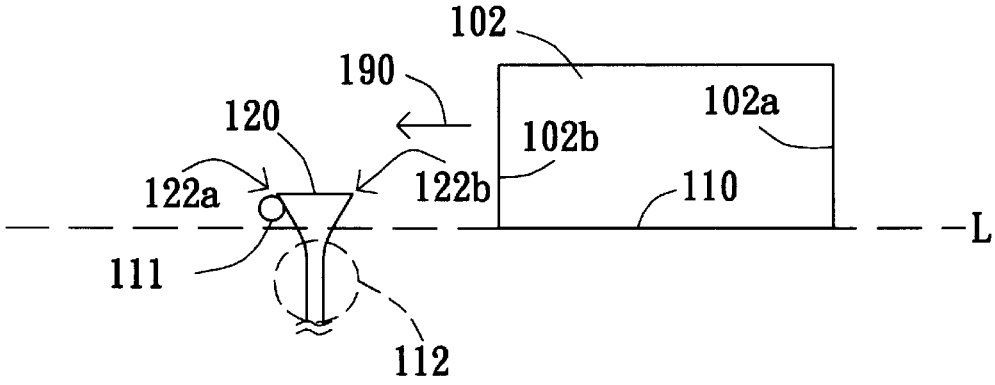
FIG. 2C (PRIOR ART)
Figure 2D:
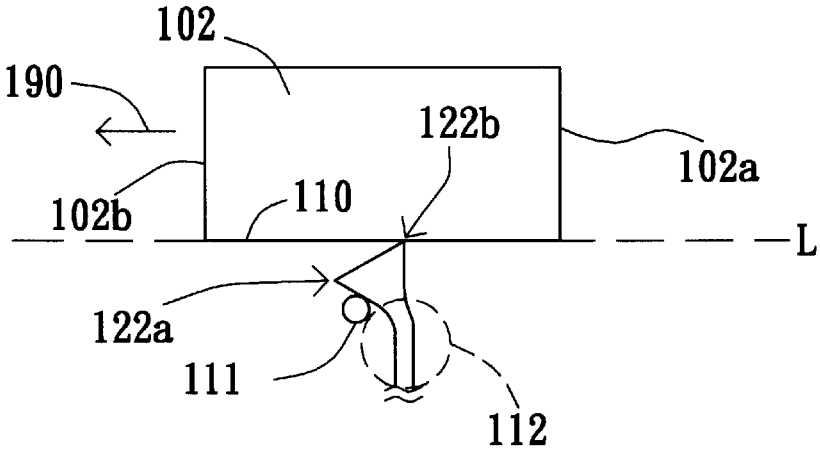
FIG. 2D (PRIOR ART)
Figure 2E:
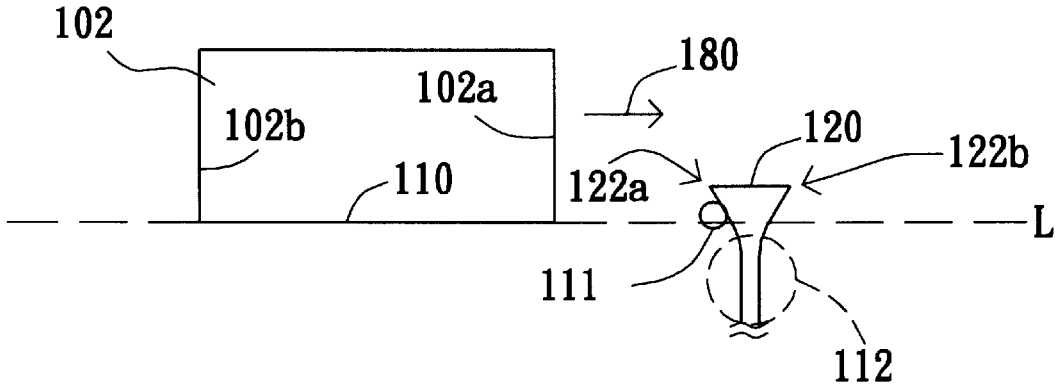
FIG. 2E (PRIOR ART)
Figure 2F:
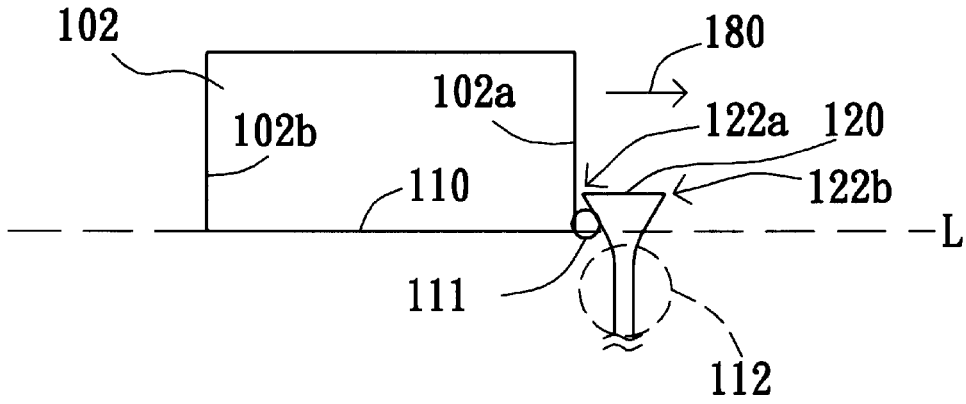
FIG. 2F (PRIOR ART)
Figure 2G:
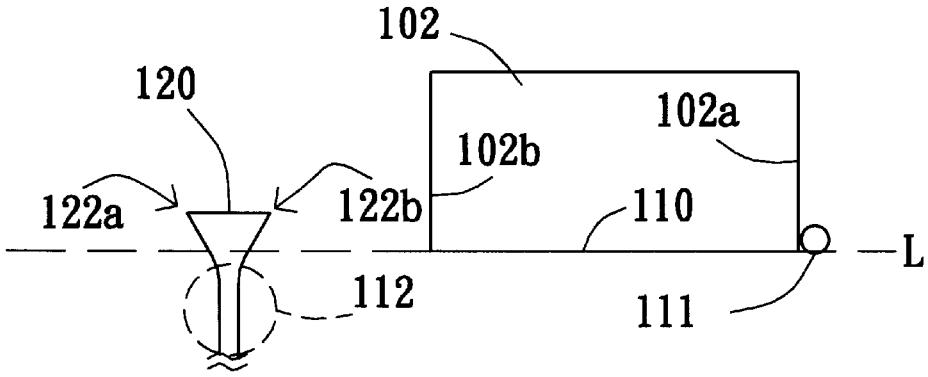
FIG. 2G (PRIOR ART)
Figure 3A:
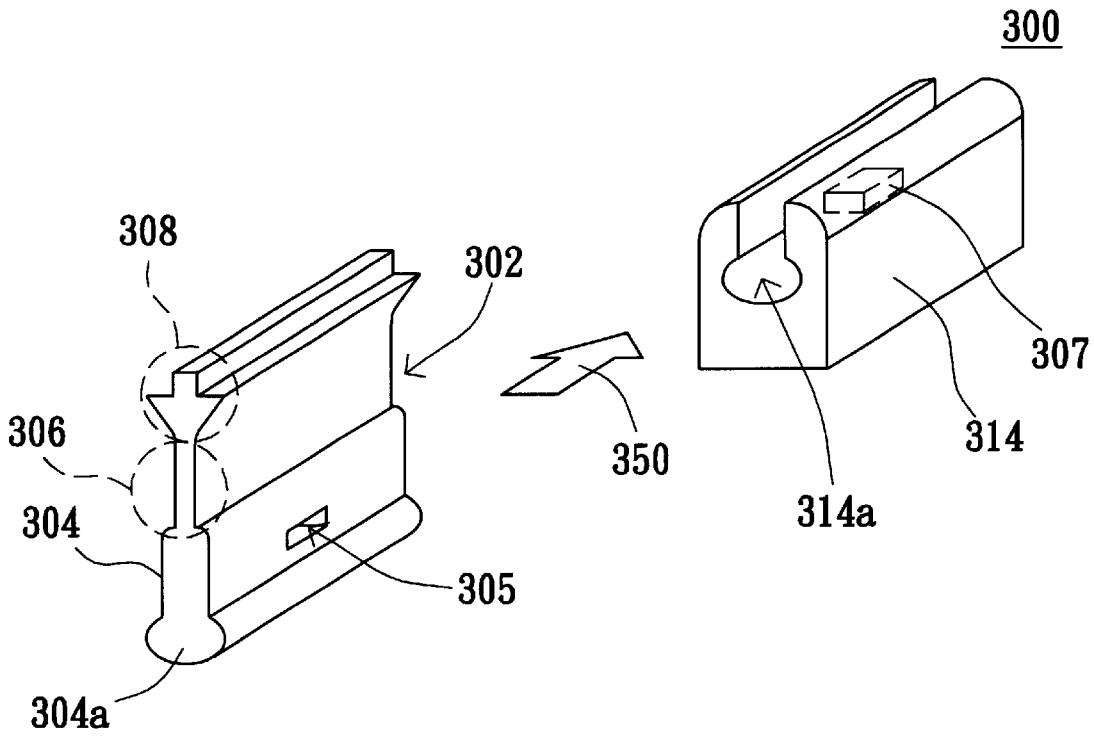
FIG. 3A is an exploded view of the wiper for avoiding ink residues on side surfaces of the print head according to the first embodiment of the invention.
Figure 3B:
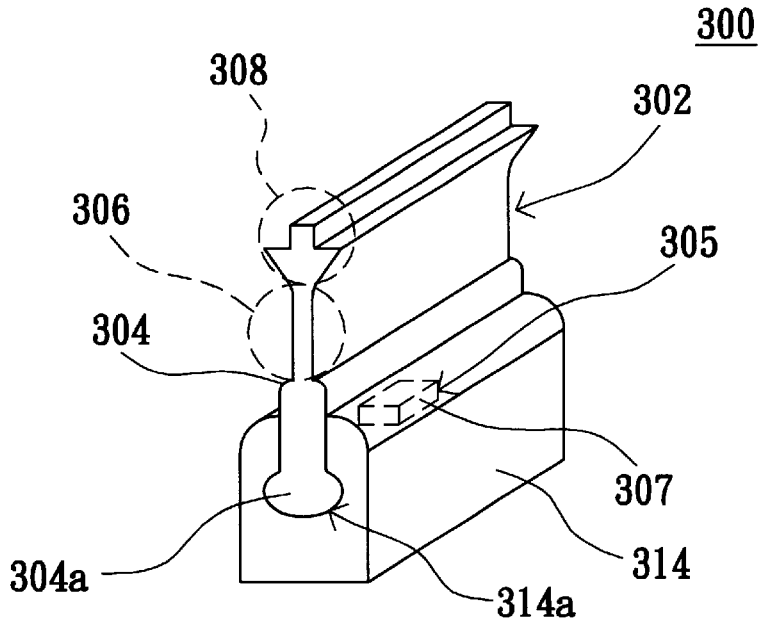
FIG. 3B is a perspective view of the wiper for avoiding ink residues on side surfaces of the print head according to the first embodiment of the invention.
Figure 3C:
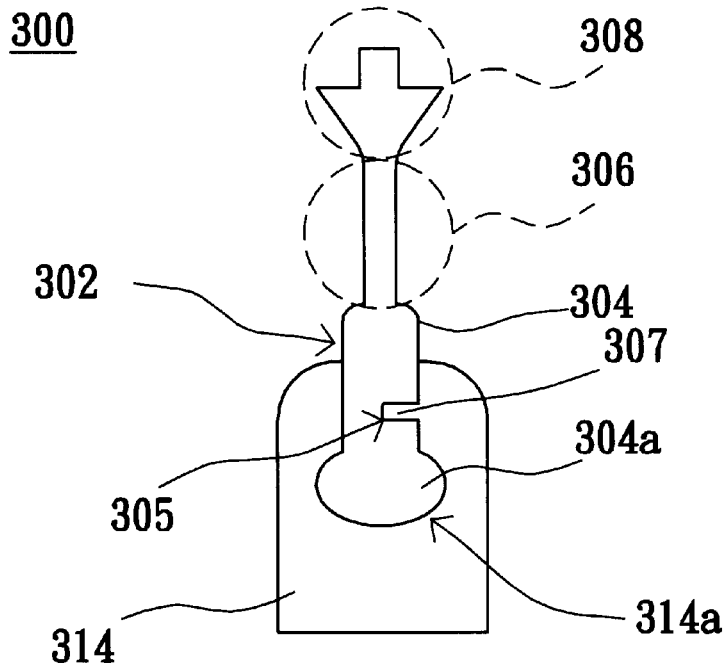
FIG. 3C is a lateral view of the wiper for avoiding ink residues on side surfaces of the print head according to the first embodiment of the invention.

Referring to FIGS. 3A, 3B, and 3C, it respectively show the exploded view, the perspective view, and the lateral view of the wiper for avoiding ink residues adhering on side surfaces of the print head according to the first embodiment of the invention. As shown in FIG. 3A, the wiper 300 is used for wiping the ink residue 111 on the print head 102 of FIG. 1B and comprises a main body 302 and a base 314. The main body 302 comprises a supporting portion 304, flexible portion 306, and wiping portion 308. The supporting portion 304 has a protruding end 304*a* and a positioning hole 305 while the base 314 has a groove 314*a* and a positioning bolt 307 disposed in the inner wall of the groove 314*a*. With a combination of the main body 302 and the base 314 along the direction of the arrow sign 350 of FIG. 3A, the protruding end 304*a* is inserted and wedged into the groove 314*a*, the positioning hole 305 receives the positing bolt 307, and therefore the main body 302 is mounted on the base 314.

Figure 3D:
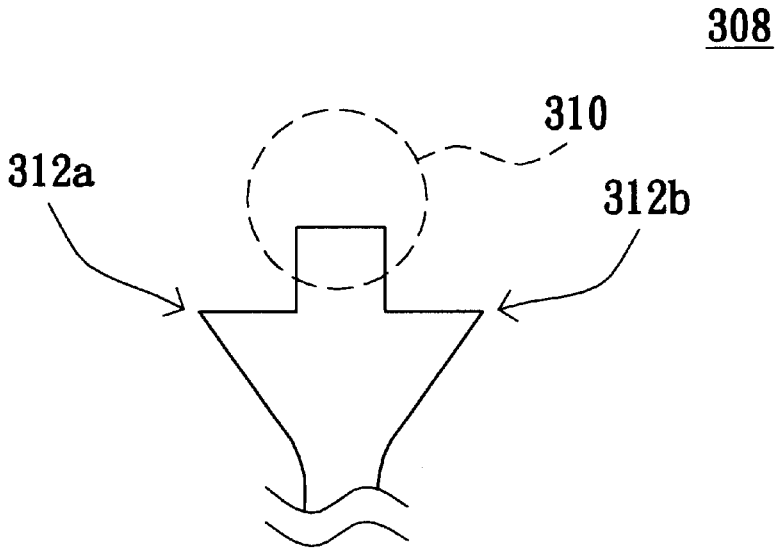
FIG. 3D is a lateral view of the wiping portion of FIG. 3C.

Referring to FIG. 3C, the flexible portion 306 is disposed upon the supporting portion 304 while the wiping portion 308 is disposed upon the flexible portion 306. The supporting portion 304, flexible portion 306, and wiping portion 308 are in one unity. Referring to FIG. 3D, it shows a view of the wiping portion of FIG. 3C. The wiping portion 308 includes a contacting end 310 and wiping ends 312*a* and 312*b*. The wiping ends 312*a* and 312*b* extend from the left and right sides of the wiping portion 308 respectively while the contacting end is positioned on the top of the wiping portion 308. As shown in FIG. 3D, the wiping portion 308 is inverted triangle-shaped while the wiping ends 312*a* and 312*b* are disposed at opposing sides of the wiping portion 308 and form two acute angles on the base side of the inverted triangle. The contacting end 310 is not level with wiping ends 312*a* and 312*b*. When the flexible portion 306 bends down, the vertex of the wiping ends 312*a* or 312*b* might be higher than the vertex of the contacting end 310.

Figure 4A:
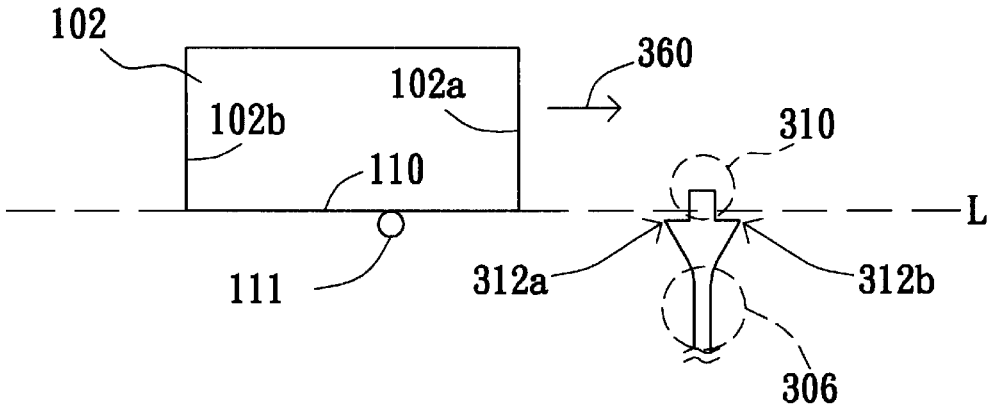
FIGS. 4A~4F schematically illustrates the wiping sequences of the wiper of FIG. 3C for wiping the ink residues.

The wiping sequences of the wiper of FIG. 3C for wiping the ink residues are schematically illustrates in FIGS. 4A~4F. Referring first to FIG. 4A, when the wiping ends 312*a* and 312*b* do not touch the nozzle surface 110, the contacting end 310 is higher than the plane level L of the nozzle surface 110 and the wiping ends 312*a* and 312*b* are lower than the plane level L of the nozzle surface 110.

Figure 4B:
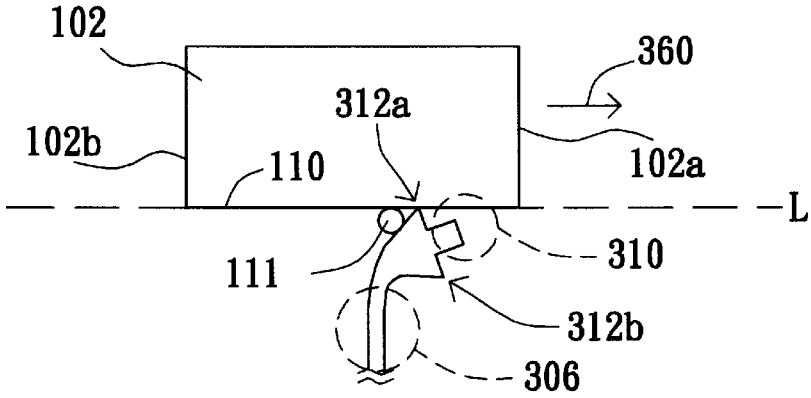

As shown in FIG. 4A, when the print head 102 approaches the contacting end 310 along the direction of the arrow sign 360 and the side surface 102*a* touches the contacting end 310, the side surface 102*a* of the print head 102 pushes the contacting end 310 so that the flexible portion 306 bends to the right and the wiping end 312*a* touches the nozzle surface 110 as shown in FIG. 4B. Before the contacting end 310 touches the print head 102, the wiping end 312*a* is lower than the nozzle surface 110; thus the side surface 102*a* is unable to touch the wiping end 312*a*. When the wiping end 312*a* touches the nozzle surface 110 and removes the ink residue 111 on the nozzle surface 110, the flexible portion 306 bends down and the wiping end 312*a* touches the nozzle surface 110; thus the contacting end 310 is unable to touch the nozzle surface 110.

Figure 4C:
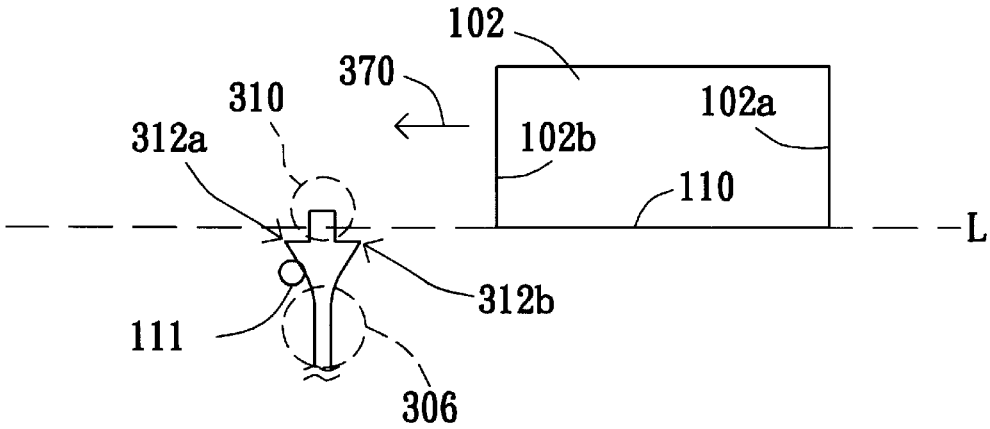
Figure 4D:
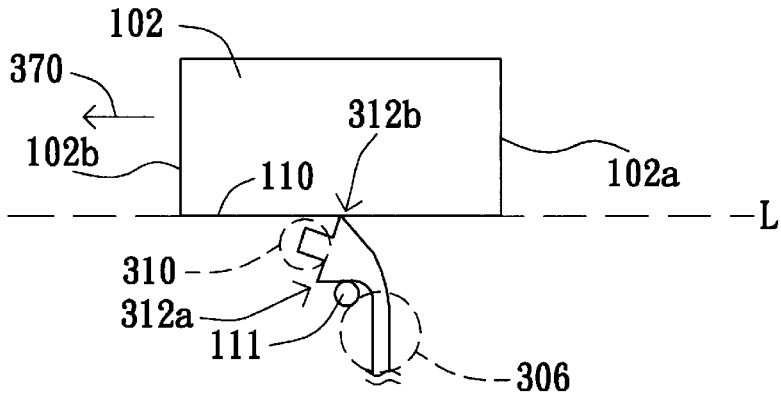

When the wiping end 312*a* comes off the nozzle surface 110, the ink residue 111 successfully adheres to the left side of the wiping end 312*a* as shown in FIG. 4C. Meanwhile, the flexible portion 306 recovers to the former shape. Referring to FIG. 4C, as the print head 102 approaches the contacting end 310 along the direction of the arrow sign 370 of FIG. 4C, the side surface 102*b* of the print head 102 touches the contacting end 310 and the print head 102 proceeds to move along the direction of the arrow sign 370. When the side surface 102*b* of the print head 102 pushes the contacting end 310, the flexible portion 306 bends to the left and the wiping end 312*b* touches the nozzle surface 110 as shown in FIG. 4D. Before the contacting end 310 touches the print head 102, the wiping end 312*b* is lower than the nozzle surface 110; thus the side surface 102*b* is unable to touch the wiping end 312*b*. When the wiping end 312*b* touches the nozzle surface 110 and removes the ink residue 111 on the nozzle surface 110, the flexible portion 306 bends down and the wiping end 312*b* touches the nozzle surface 110; thus the contacting end 310 is unable to touch the nozzle surface 110.

Figure 4E:
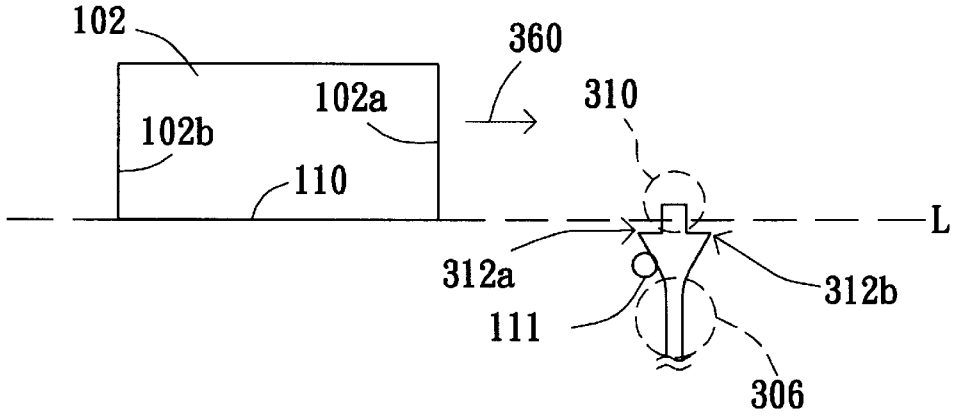
Figure 4F:
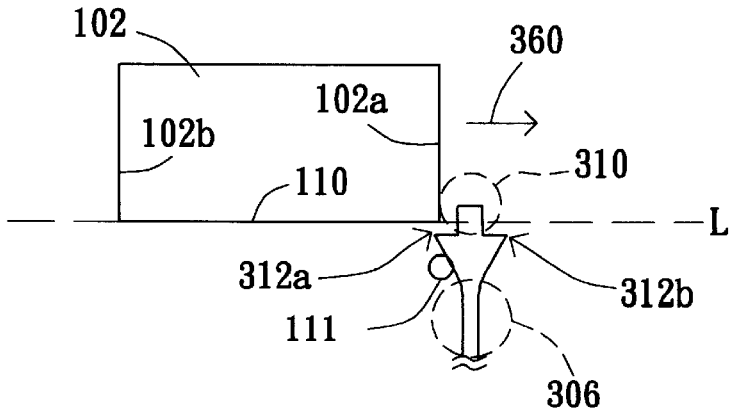

Referring to FIG. 4E, the wiping end 312*b* comes off the nozzle surface 1110 and the flexible portion 306 recovers to the former shape. The ink residue 111 remains adhering to the left side of the wiping end 312*a*. After that, when the print head 102 approaches the contacting end 310 and the side surface 102*a* of the print head 102 touches the contacting end 310 again, the ink residue 111 adhering to the left side of the wiping end 312*a* will not be shifted to the side surface 102*a* of the print head 102 since the side surface 102*a* is unable to touch the wiping end 312*a*. Subsequently, the print head 102 proceeds to move along the arrow sign 360 of FIG. 4F. The wiping end 312*a* will bend and then touch the nozzle surface 110 to perform wiping. Once the wiping end 312*b* comes off the nozzle surface 110, the ink residue 111 remains adhering to the left side of the wiping end 312*a* and the flexible portion 306 recovers to the former shape.

In the first embodiment, the wiper 300 according to the invention not only cleans the ink residue 111 on the nozzle surface 100 but also prevents the ink residue 111 from being shifted to side surface 102*a* or 102*b* of the print head 102. It avoids the ink residue 111 falling on the paper to be print 104 when the print head is quickly printing back and forth. This keeps the side surfaces of the print head clean and ensures the printing quality.

Figure 5A:
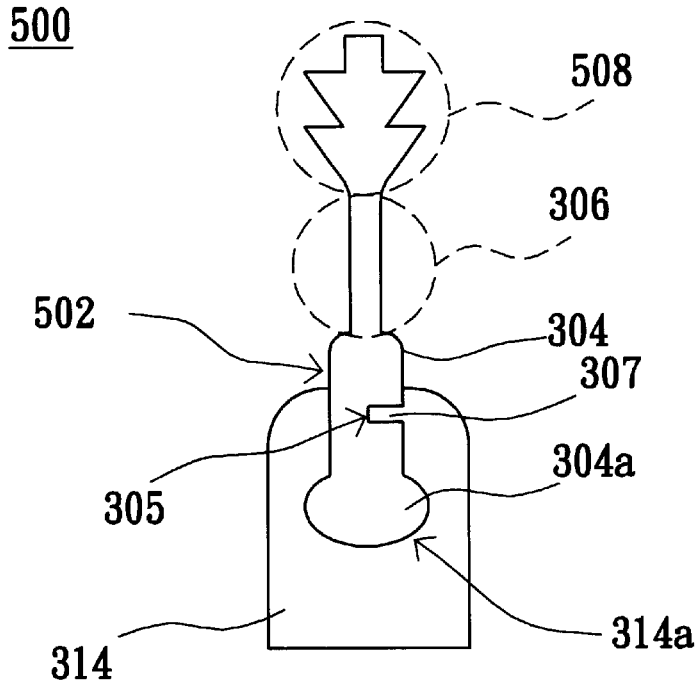
FIG. 5A shows a wiper of FIG. 3C added with two wiping ends.
Figure 5B:
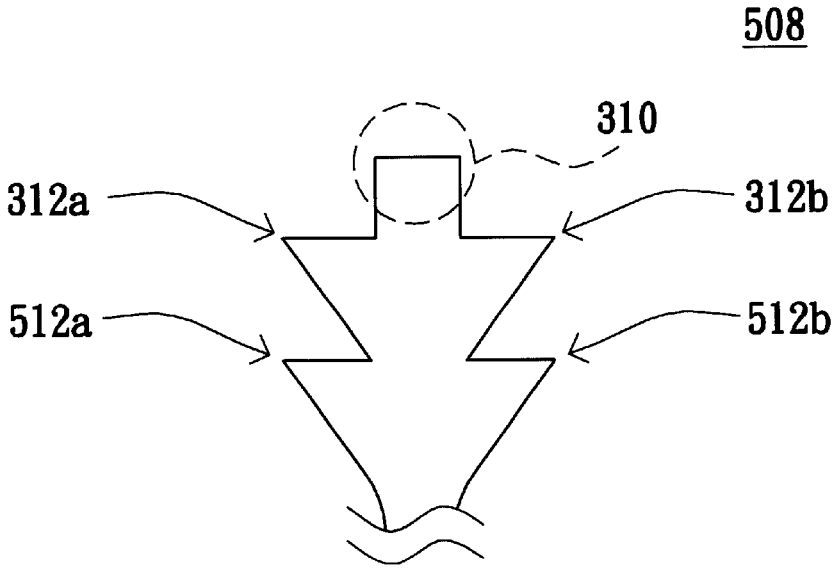
FIG. 5B is a lateral view of the wiping portion of FIG. 5A.

The wiping ends 312*a* and 312*b* in the first embodiment are respectively disposed at the opposing sides of the wiping portion 308 and form two acute angles. Furthermore, wiping end can also comprise a plurality of protrusions since the wiping effect can become even better by increasing the number of the wiping ends. Referring to FIG. 5A, it shows a wiper of FIG. 3C added with two wiping ends. The wiping portion 508 has wiping ends 312*a* and 512*a* on the left side and wiping ends 312*b* and 512*b* on the right side. The wiping sequences are similar and thus the wiping details are omitted.

Figure 6A:
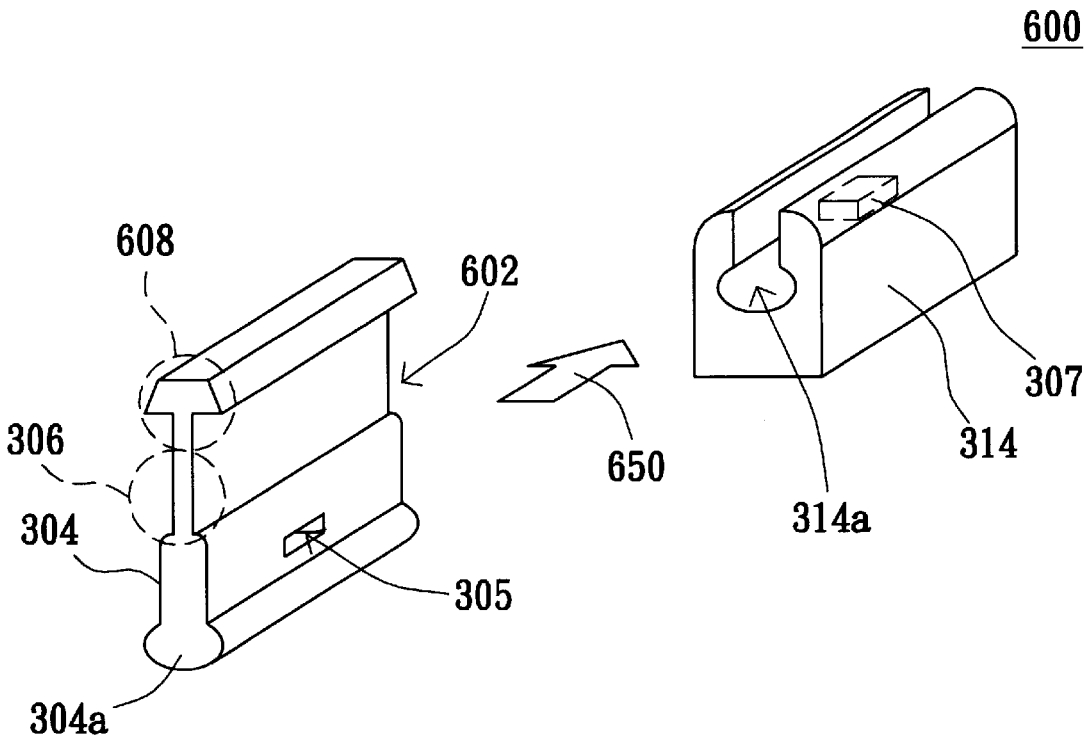
FIG. 6A is a lateral view of the wiper for avoiding ink residues adhering on side surfaces of the print head according to the second embodiment of the invention.
Figure 6B:
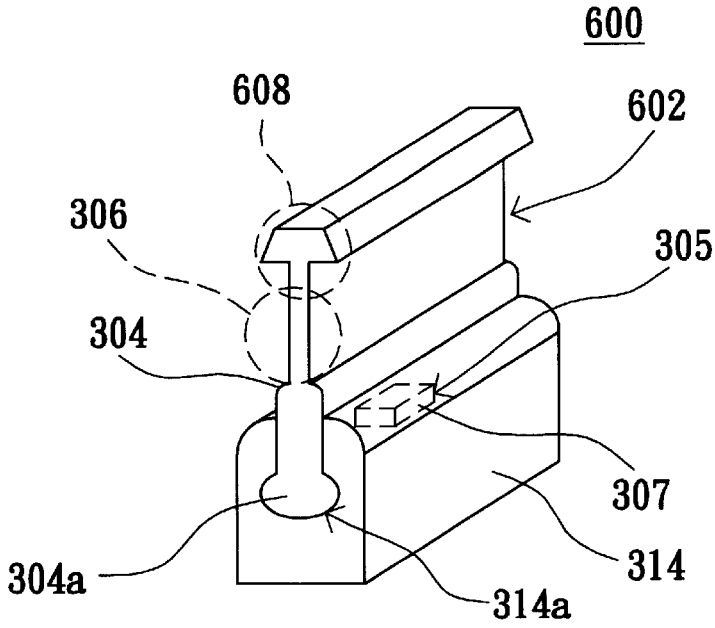
FIG. 6B is a perspective view of the wiper for avoiding ink residues adhering on side surfaces of the print head according to the second embodiment of the invention.
Figure 6C:
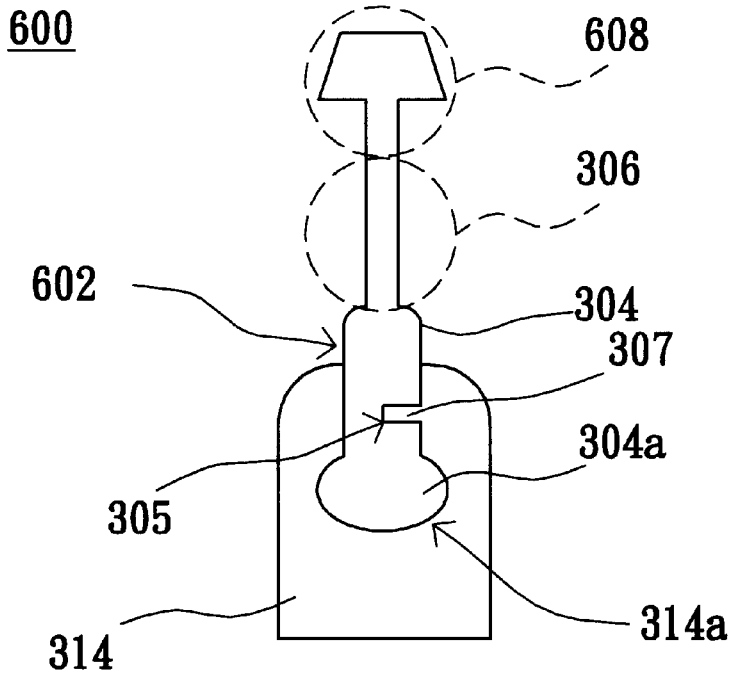
FIG. 6C is a lateral view of the wiper for avoiding ink residues adhering on side surfaces of the print head according to the second embodiment of the invention.

Referring to FIGS. 6A, 6B, and 6C, they respectively show the exploded view, perspective view, and lateral view of the wiper for avoiding ink residues on side surfaces of the print head according to the second embodiment of the invention. As shown in FIG. 6A, the wiper 600 is used for wiping the ink residue 111 on the print head 102 and comprises a main body 602 and a base 314. The main body 602 comprises a supporting portion 304, flexible portion 306, and wiping portion 608. The supporting portion 304 has a protruding end 304*a* and a positioning hole 305 while the base 314 has a groove 314*a* and a positioning bolt 307 is disposed in the inner wall of the groove 314*a*. With a combination of the main body 602 and the base 314 along the direction of the arrow sign 650 of FIG. 6A, the protruding end 304*a* is inserted and wedged into the groove 314*a*, the positioning hole 305 receives the positing bolt 307, and therefore the main body 602 is mounted on the base 314 as shown in FIGS. 6B and 6C.

Figure 6D:
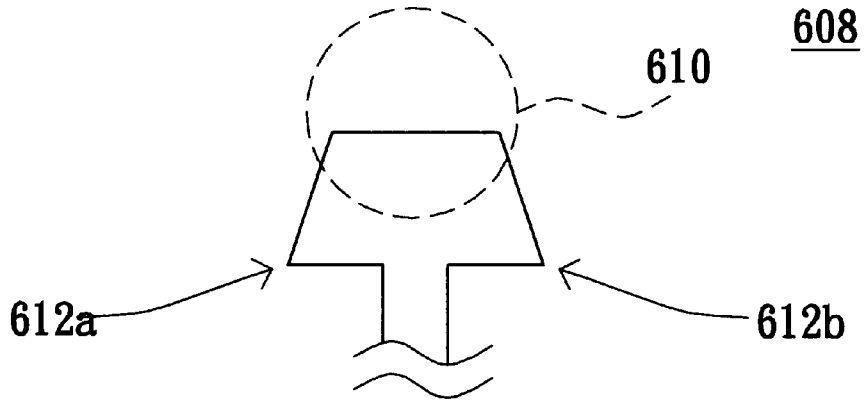
FIG. 6D is a lateral view of the wiping portion of FIG. 6C.

Referring to FIG. 6C, the flexible portion 306 is disposed upon the supporting portion 304 while the wiping portion 608 is disposed upon the flexible portion 306. The supporting portion 304, flexible portion 306, and wiping portion 308 are in one unity. Referring to FIG. 6D, it shows an enlarged view of the wiping portion of FIG. 6C. The wiping portion 608 includes a contacting end 610 and wiping ends 612*a* and 612*b*. The wiping ends 612*a* and 612*b* extend from left side and right side of the wiping portion 608 while the contacting end 610 is positioned on the top of the wiping portion 608. As shown in FIG. 6D, the wiping portion 608 is trapezoid-shaded. The contacting end 610 is used for bending the flexible portion 306 and positioned on the top of the wiping portion 608, in other words, on the upper parallel side of the trapezoid. The wiping ends 612*a* and 612*b* on opposing sides of the wiping portion 308 are disposed on the lower parallel side of the trapezoid and form two acute angles of the lower parallel side of the trapezoid. The contacting end 610 is not level with wiping ends 612*a* and 612*b*. When the flexible portion 306 bends down, the vertex of the wiping end 612*a* or 612*b* might be higher than the top of the contacting end 610.

Figure 7A:
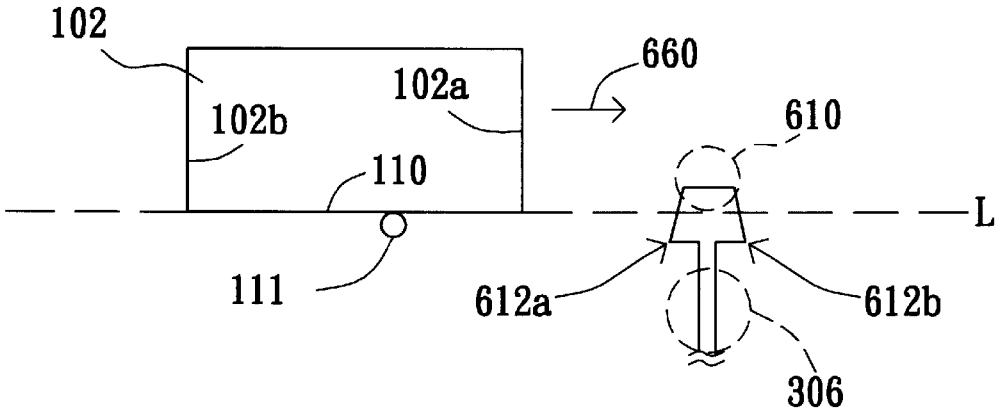
FIGS. 7A~7F schematically illustrates the wiping sequences of the wiper of FIG. 6C for wiping the ink residues.

The wiping sequences of the wiper of FIG. 6C for wiping the ink residues are schematically illustrated in FIGS. 7A~7F. Referring first to FIG. 7A, when the wiping ends 612*a* and 612*b* do not touch the nozzle surface 110, the contacting end 610 is higher than the plane level L of the nozzle surface 110 and the wiping ends 612*a* and 612*b* are lower than the plane level L of the nozzle surface 110.

Figure 7B:
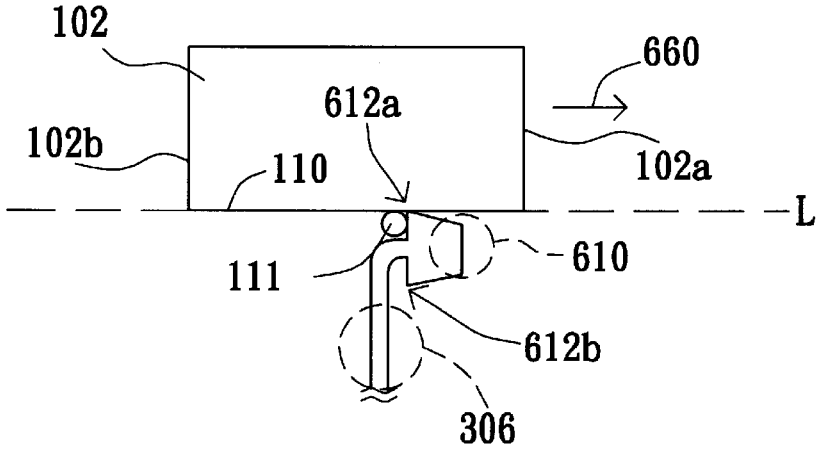

As shown in FIG. 7A, the print head 102 approaches the contacting end 610 along the direction of the arrow sign 660 of FIG. 7A. When the side surface 102*a* of the print head 102 touches the contacting end 610 and the print head 102 proceeds to move along the direction of the arrow sign 660, the side surface 102*a* of the print head 102 pushes the contacting end 610 so that the flexible portion 306 bends to the right and the wiping end 612*a* touches the nozzle surface 110 as shown in FIG. 7B. Before the contacting end 610 touches the print head 102, the wiping end 612*a* is lower than the nozzle surface 110; thus the side surface 102*a* is unable to touch the wiping end 612*a*. When the wiping end 612*a* touches the nozzle surface 110 and removes the ink residue 111 on the nozzle surface 110, the flexible portion 306 bends down and the contacting end 610 is lower than the nozzle surface 110; thus the contacting end 610 is unable to touch the nozzle surface 110.

Figure 7C:
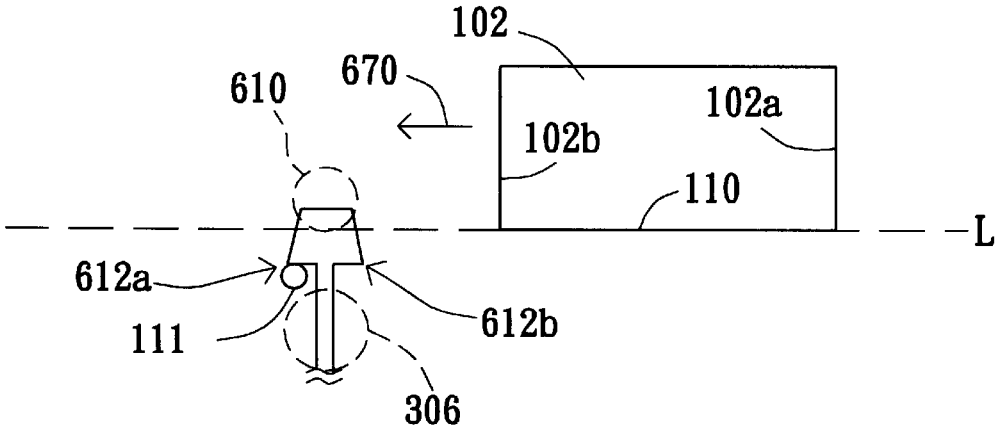
Figure 7D:
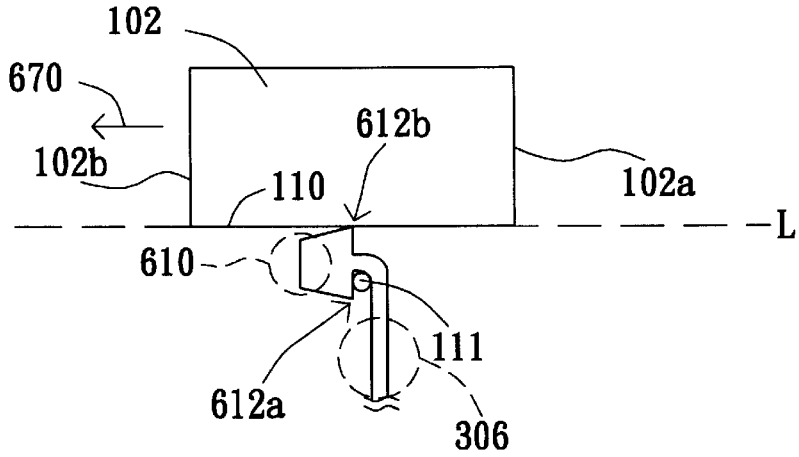

When the wiping end 612*a* comes off the nozzle surface 110, the ink residue 111 has successfully adhered to the left side of the wiping end 612*a* as shown in FIG. 7C. Meanwhile, the flexible portion 306 recovers to the former shape. Referring to FIG. 7C, the print head 102 approaches the contacting end 610 along the direction of the arrow sign 670. When the side surface 102*b* of the print head 102 touches the contacting end 610 and the print head 102 proceeds to move along the direction of the arrow sign 670, the side surface 102*b* of the print head 102 subsequently pushes the contacting end 610 so that the flexible portion 306 bends to the left and the wiping end 612*a* touches the nozzle surface 110 as shown in FIG. 7D. Before the contacting end 610 touches the print head 102, the wiping end 612*b* is lower than the nozzle surface 110; thus the side surface 102*b* is unable to touch the wiping end 612*b*. When the wiping end 612*b* touches the nozzle surface 110 and removes the ink residue 111 on the nozzle surface 110, the flexible portion 306 bends down and the contacting end 610 is lower than the nozzle surface 110; thus the contacting end 610 is unable to touch the nozzle surface 110.

Figure 7E:
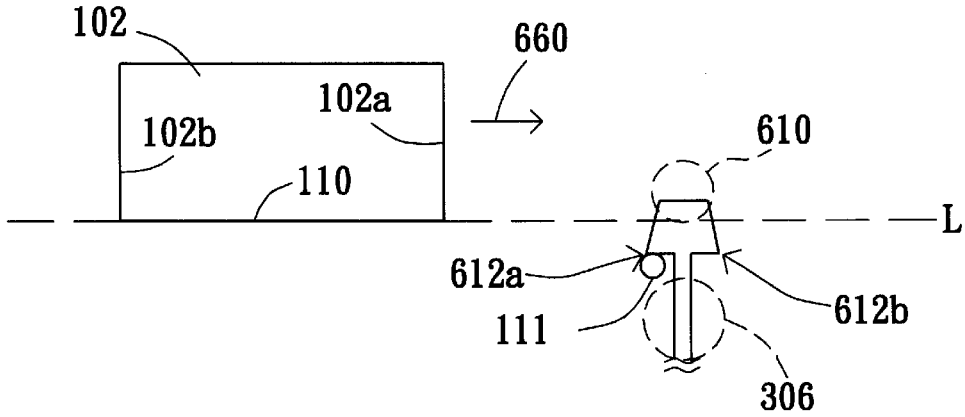
Figure 7F:
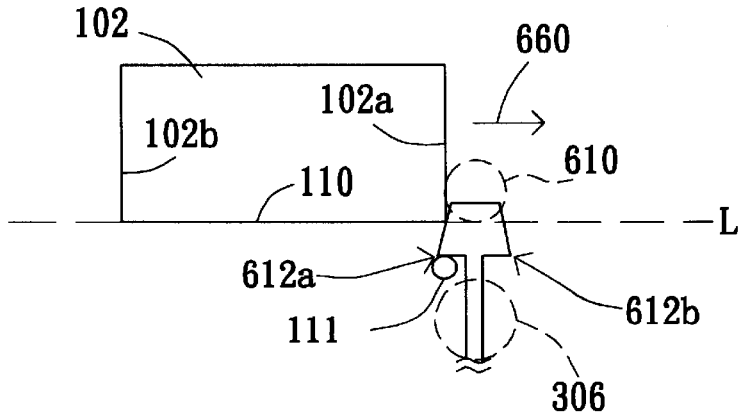

Referring to FIG. 7E, the wiping end 612*b* comes off the nozzle surface 110 and the flexible portion 306 recovers to the former shape. The ink residue 111 remains adhering to the left side of the wiping end 612*a*. When the print head 102 approaches the contacting end 610 and the side surface 102*b* of the print head 102 touches the contacting end 610 again, the ink residue 111 adhering to the left side of the wiping end 612*a* will not be shifted to the side surface 102*a* of the print head 102 since the side surface 102*a* is unable to touch the wiping end 612*a*. Subsequently, the print head 102 proceeds to move along the arrow sign 660 of FIG. 7F. The wiping end 612*a* touches the nozzle surfaces 110 and performs wiping. Once the wiping end 612*b* comes off the nozzle surface 110, the ink residue 111 remains adhering to the left side of the wiping end 612*a* and the flexible portion 306 recovers to the former shape.

In the second embodiment, the wiper 600 according to the invention not only cleans the ink residue 111 on the nozzle surface 110 but also prevents the ink residue 111 from being shifted to side surface 102*a* or 102*b* of the print head 102. It avoids the ink residue 111 falling on the paper to be print 104 when the print head is quickly printing back and forth. This keeps the side surfaces of the print head clean and ensures the printing quality.

Figure 8A:
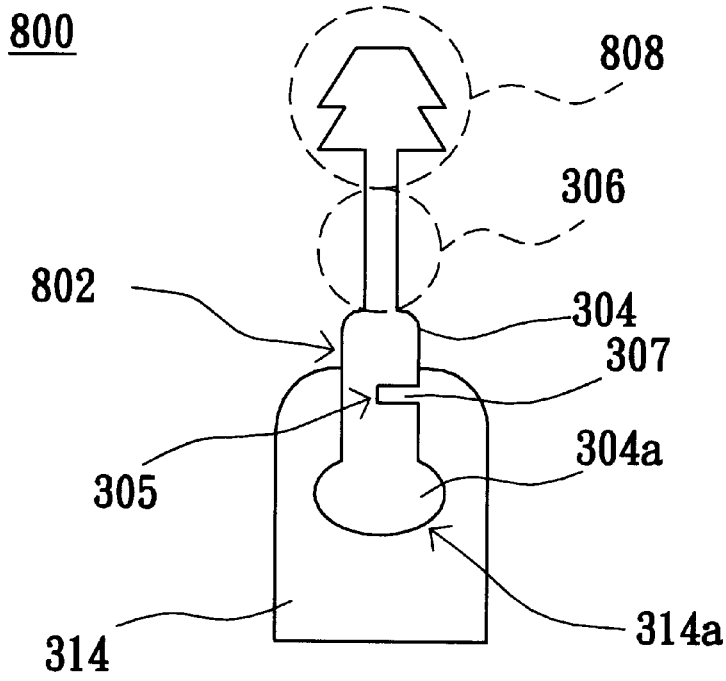
FIG. 8A shows a wiper of FIG. 6C with two wiping ends.
Figure 8B:
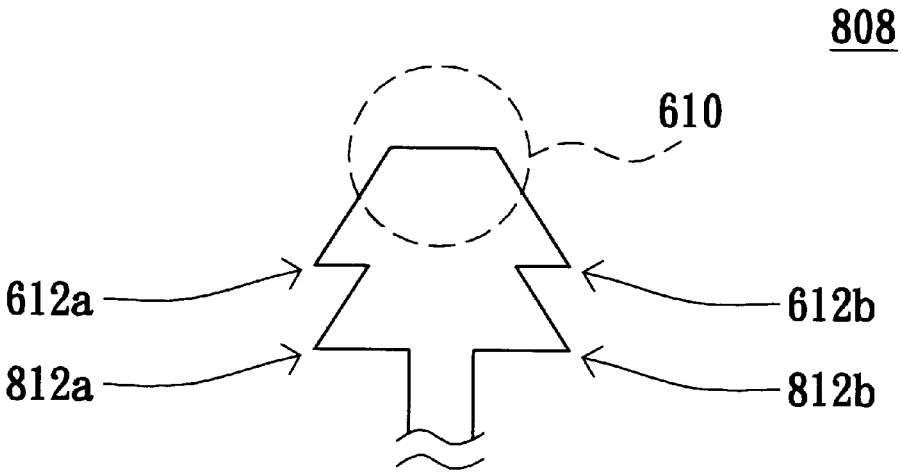
FIG. 8B is a lateral view of the wiping portion of FIG. 8A.

The wiping ends 612*a* and 612*b* in the second embodiment are respectively disposed at the opposing sides of the wiping portion 608 and form two acute angles. Furthermore, wiping end can also comprise a plurality of protrusions since the wiping effect can become even better by increasing the number of the wiping ends. Referring to FIG. 8A, showing a wiper of FIG. 6C added with two wiping ends. The wiping portion 808 has wiping ends 612*a* and 812*a* on the left side and wiping ends 612*b* and 812*b* on the right side. The wiping sequences are similar and the wiping details are omitted.

The wiping portion according to the invention at least comprises a contacting end and a wiping end on the condition that the contacting end is positioned on the top of the wiping portion while the wiping end extends from one side of the wiping portion. Before wiping, the contacting end is higher than the nozzle surface and the wiping end is lower than the nozzle surface. During wiping, the contacting end is unable to touch the nozzle surface and the wiping end is unable to touch the side surface of the print head. It prevents the ink residues on the main body from being shifted to the side surfaces of the print head. Besides, the wiper with more wiping ends can increase the wiping effect.

The wiper according to the aforementioned embodiments avoids ink residues from being shifted to the side surfaces of the print head again by the special design of the contacting end and the wiping end. It keeps side surfaces of the print head clean and prevents the contamination of ink residues to ensure the printing quality.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wiper for avoiding ink residues adhering on side surfaces of a print head, the wiper comprising:

a main body, comprising:

a supporting portion;

a flexible portion, disposed upon the supporting portion; and a wiping portion, disposed upon the flexible portion, the wiping portion having:

a wiping end, extending from one side of the wiping portion; and a contacting end, positioned on the top of the wiping portion, wherein the contacting end is located higher than a nozzle surface and the wiping end is located lower than the nozzle surface before the print head contacts the contacting end; the flexible portion bends down due to the relative motion between the print head and the wiper after the print head contacts the contacting end so that the contacting end is lower than the nozzle surface and the wiping end contacts the nozzle surface for wiping the ink residue on the nozzle surface.

2. The wiper according to claim 1 further comprising a base.

3. The wiper according to claim 2, wherein the base has a groove for inserting the supporting portion so that the main body is mounted on the base.

4. The wiper according to claim 3, wherein the supporting portion comprises a protruding end for being wedged in the groove.

5. The wiper according to claim 3, wherein the base further comprises a positioning bolt, which is disposed in the inner wall of the groove.

6. The wiper according to claim 5, wherein the supporting portion has a positioning hole for receiving the positing bolt when the supporting portion is inserted into the groove.

7. The wiper according to claim 1, wherein the wiping portion has two wiping ends on opposing sides of the wiping portion.

8. The wiper according to claim 7, wherein the wiping end comprises a plurality of protrusions.

9. The wiper according to claim 1, wherein the wiping end forms an acute angle.

10. The wiper according to claim 1, wherein the supporting portion, the flexible portion and the wiping portion are in one unity.

11. The wiper according to claim 1, wherein the wiping portion is inverted triangle-shaped and the wiping end is disposed on the base of the inverted triangle.

12. The wiper according to claim 1, wherein the wiping portion is trapezoid-shaded and the wiping end is disposed on the lower parallel side of the trapezoid.

* * * * *